US008882964B2

(12) United States Patent
Zhao et al.

(10) Patent No.: US 8,882,964 B2
(45) Date of Patent: Nov. 11, 2014

(54) FURNISH PRETREATMENT TO IMPROVE PAPER STRENGTH AID PERFORMANCE IN PAPERMAKING

(75) Inventors: Yulin Zhao, Shanghai (CN); Jun Li, Shanghai (CN); Qing Long Rao, Shanghai (CN); Weiguo Cheng, Naperville, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 13/399,253

(22) Filed: Feb. 17, 2012

(65) Prior Publication Data

US 2013/0133847 A1 May 30, 2013

(30) Foreign Application Priority Data

Nov. 25, 2011 (CN) ..... 2011 1 0382058

(51) Int. Cl.

| | |
|---|---|
| ***D21H 21/18*** | (2006.01) |
| ***D21H 11/14*** | (2006.01) |
| ***D21H 23/14*** | (2006.01) |
| ***D21H 17/37*** | (2006.01) |

(52) U.S. Cl.

CPC ..... *D21H 17/375* (2013.01); *D21H 23/14* (2013.01); *D21H 11/14* (2013.01); *D21H 21/18* (2013.01)

USPC ..... 162/147; 162/158; 162/166; 162/168.3; 162/175; 162/183

(58) Field of Classification Search

CPC ..... D21H 11/14; D21H 17/33; D21H 17/37; D21H 17/375; D21H 17/455; D21H 17/55; D21H 21/18; D21H 21/20; D21C 5/02

USPC ..... 162/4, 141, 147, 158, 164.1, 164.3, 162/164.6, 165–166, 175, 183

See application file for complete search history.

(56) References Cited

U.S. PATENT DOCUMENTS

| | | | | | |
|---|---|---|---|---|---|
| 3,556,932 | A * | 1/1971 | Coscia et al. | 162/166 |
| 3,840,489 | A * | 10/1974 | Strazdins, Edward | 524/816 |
| 4,217,425 | A * | 8/1980 | Ballweber et al. | 525/155 |
| 4,233,411 | A * | 11/1980 | Ballweber et al. | 525/155 |
| 4,508,594 | A * | 4/1985 | Jansma et al. | 162/135 |
| 4,605,702 | A * | 8/1986 | Guerro et al. | 525/154 |
| 5,490,904 | A * | 2/1996 | Jansma et al. | 162/168.2 |
| 5,674,362 | A * | 10/1997 | Underwood et al. | 162/164.3 |
| 5,783,041 | A * | 7/1998 | Underwood | 162/164.1 |
| 5,958,180 | A * | 9/1999 | Hubbe et al. | 162/9 |
| 6,059,928 | A * | 5/2000 | Van Luu et al. | 162/111 |
| 6,071,379 | A * | 6/2000 | Wong Shing et al. | 162/168.2 |
| 6,455,661 | B1 * | 9/2002 | Antal et al. | 527/300 |
| 6,592,718 | B1 * | 7/2003 | Wong Shing et al. | 162/164.1 |
| 6,605,674 | B1 * | 8/2003 | Whipple et al. | 526/78 |
| 6,723,204 | B2 * | 4/2004 | Van Handel et al. | 162/183 |
| 7,828,934 | B2 * | 11/2010 | Cyr et al. | 162/166 |
| 7,863,395 | B2 * | 1/2011 | Hagiopol et al. | 526/220 |
| 7,897,013 | B2 * | 3/2011 | Hagiopol et al. | 162/166 |
| 7,901,543 | B2 * | 3/2011 | St. John et al. | 162/166 |
| 8,088,250 | B2 * | 1/2012 | Cheng et al. | 162/162 |
| 8,419,899 | B2 * | 4/2013 | Xia et al. | 162/161 |
| 2002/0059990 | A1 * | 5/2002 | Bush et al. | 162/3 |
| 2002/0062934 | A1 * | 5/2002 | Bush et al. | 162/4 |
| 2003/0188840 | A1 * | 10/2003 | Van Handel et al. | 162/164.1 |
| 2006/0084771 | A1 * | 4/2006 | Wong Shing et al. | 526/217 |
| 2006/0249269 | A1 * | 11/2006 | Kurian et al. | 162/168.3 |
| 2009/0312512 | A1 * | 12/2009 | Kurian et al. | 526/307.2 |
| 2010/0186914 | A1 * | 7/2010 | Jehn-Rendu et al. | 162/164.6 |
| 2010/0193148 | A1 * | 8/2010 | McKay et al. | 162/164.6 |
| 2010/0326614 | A1 * | 12/2010 | Hund et al. | 162/164.6 |
| 2011/0056640 | A1 * | 3/2011 | Cyr et al. | 162/164.1 |
| 2011/0067832 | A1 * | 3/2011 | Xia et al. | 162/161 |
| 2011/0155339 | A1 * | 6/2011 | Brungardt et al. | 162/164.6 |
| 2011/0244258 | A1 * | 10/2011 | Vonfelden | 428/514 |
| 2012/0103547 | A1 * | 5/2012 | Grimm et al. | 162/164.1 |
| 2012/0186764 | A1 * | 7/2012 | McKay | 162/164.6 |
| 2013/0186583 | A1 * | 7/2013 | Xia et al. | 162/161 |

FOREIGN PATENT DOCUMENTS

| | | | |
|---|---|---|---|
| GB | 2339208 | A * | 1/2000 |
| JP | 2008255496 | A * | 10/2008 |
| WO | WO 9521298 | A1 * | 8/1995 |
| WO | WO 2010088473 | A1 * | 8/2010 |
| WO | WO 2012100156 | A1 * | 7/2012 |
| WO | WO 2012125235 | A2 * | 9/2012 |

OTHER PUBLICATIONS

Machine Translation of JP 2008-255496 A, published on Oct. 2008.*

* cited by examiner

*Primary Examiner* — Jose Fortuna

(74) *Attorney, Agent, or Firm* — Benjamin E. Carlsen

(57) ABSTRACT

The invention is directed towards methods, compositions, and apparatus for increasing the strength of paper made out of a furnish having a large proportion of OCC. The method involves the following steps: 1) Providing a paper furnish having a large amount of OCC in it, 2) adding strength promoter to the furnish prior to adding a strength agent to the furnish, 3) adding a strength agent to the furnish, and 4) making a paper product from the furnish. This method allows cheap OCC material to be used in a papermaking process without the quality problems that the anionic trash in OCC typically causes. Thus paper products having low costs and high quality can be produced.

12 Claims, 2 Drawing Sheets

FURNISH PRETREATMENT TO IMPROVE PAPER STRENGTH AID PERFORMANCE IN PAPERMAKING

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to methods of, apparatuses for, and compositions of matter useful in, pretreating furnish to increase the resulting strength of paper sheet made from furnish containing large amounts of anionic trash. Various properties of paper products, including strength, opacity, smoothness, porosity, dimensional stability, pore size distribution, linting propensity, density, stiffness, formation and compressibility are primarily due to the bonds which exist between the cellulosic fibers in the paper. The bonding capability of these fibers is enhanced by the mechanical beating or refining step(s) of the papermaking process, during which the fibers are made more flexible and the available surface area is increased.

The strength of paper products is a property having three categories, referred to as dry strength, wet strength or rewetted strength, and wet web strength. Dry strength is the strength exhibited by the dry paper sheet, typically conditioned under constant humidity and room temperature prior to testing. Wet strength, or rewetted strength, is the strength exhibited by a paper sheet that has been fully dried and then rewetted with water prior to testing. Wet web strength is strength of a cellulosic fiber mat prior to drying to a paper product. Strength additives are compositions of matter effective at increasing one or more of these strengths.

Strength resins are polymers generally added at the wet end of the papermaking process to the cellulosic slurry, prior to the formation of the paper mat or sheet, to improve the strength characteristics of the paper product. Strength resins are generally believed to work by supplementing the number of inter-fiber bonds.

Dry strength additives are used to increase the dry strength of various paper products including paper, paperboard, tissues and others. Dry strength additives are particularly useful in the manufacture of paper products from recycled fibers, as recycling is known to have a weakening effect on the resulting paper. In addition, dry strength additives should reduce the amount of refining required to achieve a given dry strength for a given pulp, and the corresponding energy consumption required for refining and should not adversely affect the drainage rate of the cellulose web on the papermaking machine.

Various approaches for using polyacrylamides and other polymers to increase dry strength of paper products have been described in U.S. Pat. Nos. 6,315,866, 7,556,714, 2,884,057, and 5,338,406 and U.S. patent application Ser. No. 12/323,976. These methods however have been disappointing when furnish contains large amount of anionic trash such as old corrugated cardboard (OCC), mechanic pulps. It is believed that this is due to the exceptionally high number anionic moieties present in this furnish which prevent the strength aid from bonding with the paper fibers.

It is therefore useful and desirable to provide compositions, methods, and apparatuses useful in improving the effectiveness of strength aids in furnish containing large amounts of anionic trash. The art described in this section is not intended to constitute an admission that any patent, publication or other information referred to herein is "Prior Art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed to a method of increasing the strength of a paper product. The method comprises the steps of: a) providing a furnish comprising fibers, the fibers in the furnish made up of at least 10% fibers containing significant amount of anionic trash, b) adding strength promoter to the furnish prior to adding a strength agent to the furnish, c) adding a strength agent to the furnish, and d) making a paper product out of the furnish according to a papermaking process.

The strength promoter may be added in an amount equal to 0.01 to 3 lb/ton of the furnish. The strength promoter may have an RSV between 0.5 to 15, 1 to 12, 2 to 8, and/or 3 to 6. The anionic trash containing furnish may be one selected from the list consisting of recycled fibers or mechanic fibers, and any combination thereof. The strength agent may be a dry strength agent. The strength agent may be starch, polyacrylamide, glyoxalated polyacrylamide, or any combination thereof. The strength agent may be a dry strength agent which is added in an amount equal to between 0.5-10 kg/ton of furnish.

Additional features and advantages are described herein, and will be apparent from, the following Detailed Description.

DETAILED DESCRIPTION OF THE INVENTION

Figure 1:
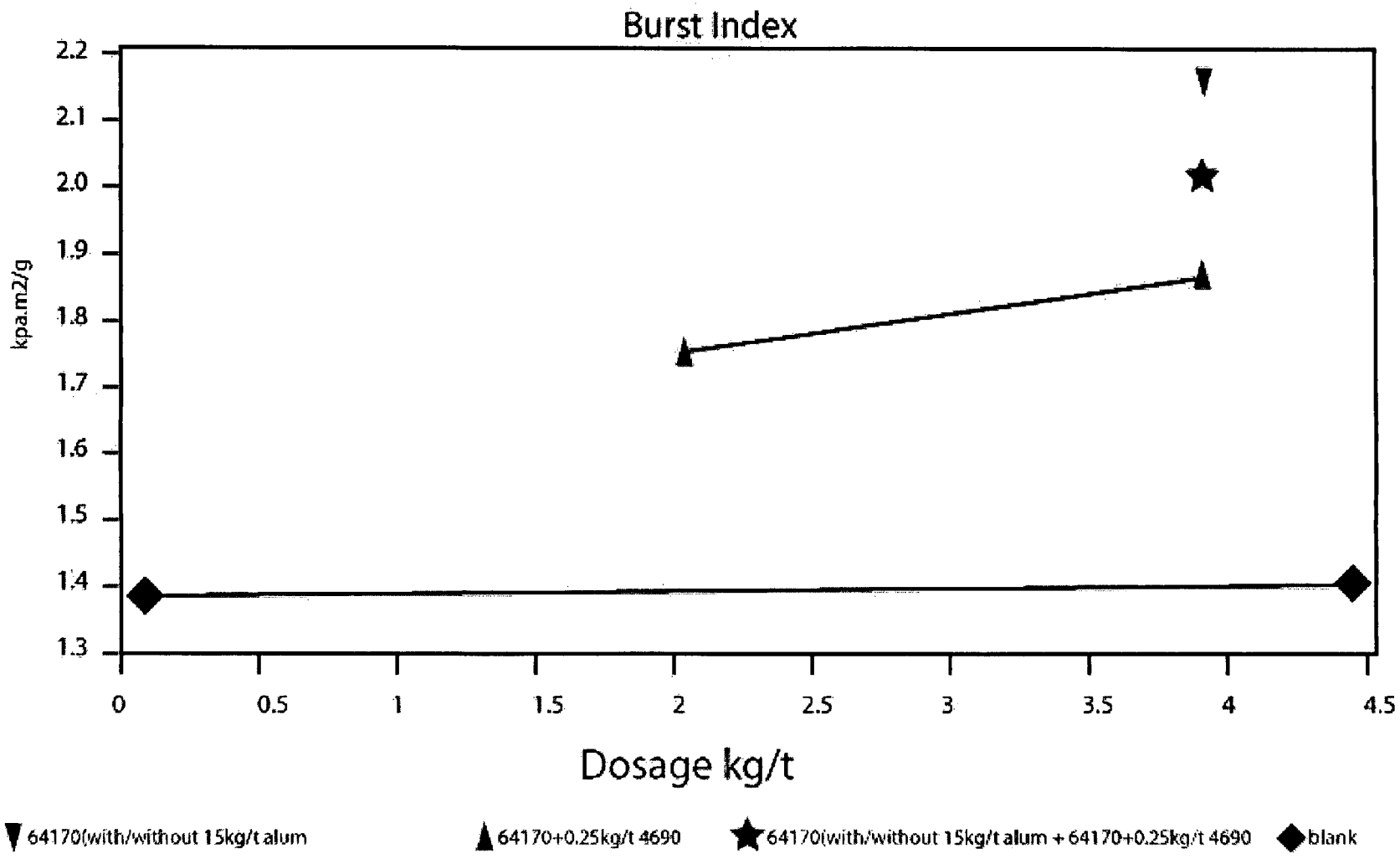
FIG. 1 is a graph which demonstrates how the invention increases the burst strength of the paper product.
Figure 2:
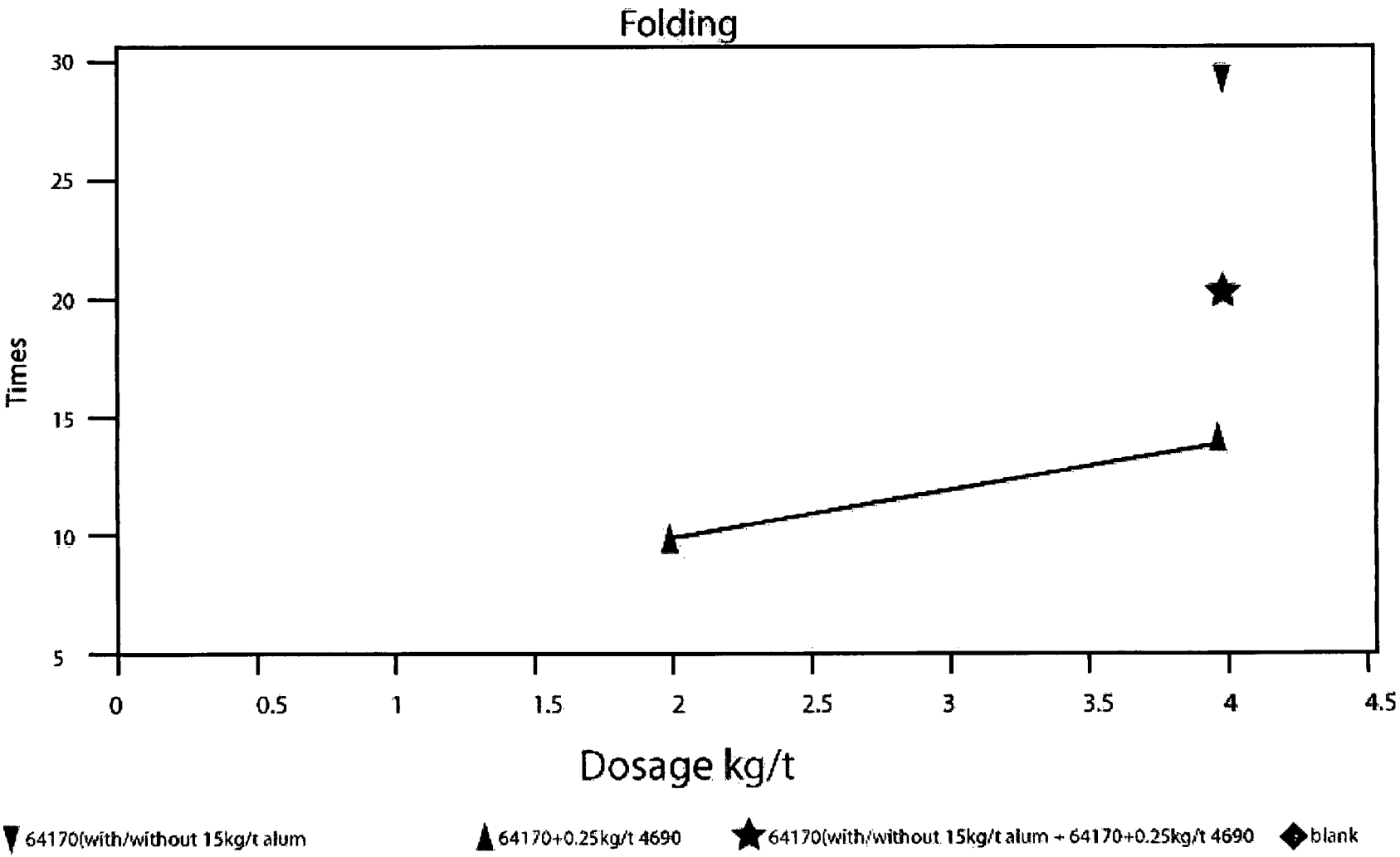
FIG. 2 is a graph which demonstrates how the invention increases the folding endurance of the paper product.

The following definitions are provided to determine how terms used in this application, and in particular how the claims, are to be construed. The organization of the definitions is for convenience only and is not intended to limit any of the definitions to any particular category.

"AcAm" means acrylamide.

"DADMAC" means diallyldimethylammonium chloride.

"Anionic Trash" means a property of OCC containing furnish used in a papermaking process characterized by the presence of such a large number of anionic moieties being present in the furnish that strength aids are inhibited or prevented from bonding with fibers and thereby the overall quality of the resulting paper is impaired.

"Dry Strength Additive" Means a strength additives that increases the dry strength of the resulting paper and includes but is not limited to any one of the strength increasing compositions of matter described in U.S. Pat. No. 4,605,702 and US Patent Application 2005/0161181 A1 and in particular the various glyoxylated Acrylamide/DADMAC copolymer compositions described therein. An example of a glyoxylated Acrylamide/DADMAC copolymer composition is product# Nalco 64170 (made by Nalco Company, Naperville, Ill.)

"GPAM" means glyoxylated polyacrylamide.

"OCC" means old corrugated container, (or old cardboard). OCC pulp has is pulp which has previously passed through at least two recycling processes. As a result its fibers are much shorter and weaker than original fibers. The bonding between these shorter fibers is significantly weaker which leads to very poor quality in terms of paper strength, such as burst strength, folding strength, and tensile strength. OCC also carries significant amount of anionic trash which causes strength agents to lose their efficiency. OCC includes but is not limited to AOCC (American old corrugated container), JOCC (Japan old corrugated container), EOCC (European old corrugated container), and COCC (Chinese old corrugated container) each of which are known in the art to posses specific and unique properties and characteristics.

"Papermaking Process" means a method of making paper products from pulp comprising grinding wood chips and/or other sources of cellulosic fibers and adding water to form an aqueous cellulosic papermaking furnish, draining the furnish to form a sheet, pressing the sheet to remove additional water, and drying the sheet. The steps of forming the papermaking furnish, draining, pressing, and drying may be carried out in any conventional manner generally known to those skilled in the art. The papermaking process includes pulp making.

"Reduced Specific Viscosity" (RSV) is an indication of polymer chain length and average molecular weight. The RSV is measured at a given polymer concentration and temperature and calculate as follows:

$$RSV = \frac{\left[\left(\frac{\eta}{\eta_0}\right) - 1\right]}{c}$$

wherein $\eta$=viscosity of polymer solution;

$\eta_o$=viscosity of solvent at the same temperature; and c=concentration of polymer in solution.

As used herein, the units of concentration "c" are (grams/100 ml or g/deciliter). Therefore, the units of RSV are dl/g. The RSV is measured at 30° C. The viscosities $\eta$ and $\eta o$ are measured using a Cannon-Ubbelohde semimicro dilution viscometer, size 75. This viscometer is mounted in perfectly vertical position in a constant temperature bath adjusted to 30±0.02° C. The error inherent in the calculation of RSV is about 0.5 dl/g.

"Strength Additive" means a composition of matter that, when added to the papermaking process, increases the strength of the paper, the increase can be by up to about 10 percent or more.

"Strength Promoter" means a composition of matter selected from the list consisting of epichlorohydrin-dimethylamine (EPI-DMA), EPI-DMA ammonia crosslinked polymers, polymers of ethylene dichloride and ammonia, polymers of ethylene dichloride, polymers of dimethylamine, condensation polymers of multifunctional diethylenetriamine, condensation polymers of multifunctional tetraethylenepentamine, condensation polymers of multifunctional hexamethylenediamine condensation polymers of multifunctional ethylenedichloride, melamine polymers, formaldehyde resin polymers, cationically charged vinyl addition polymers, copolymers of acrylamide and sodium acrylate, acrylamide homopolymer that has been hydrolyzed to convert a portion of the acrylamide groups to acrylic acid, copolymers of acrylamide and sodium acrylate, copolymers of acrylamide and sodium acrylate with sodium acrylate, and any combination thereof. Strength promoters typically have a weight average molecular weight between 800,000 and 3,000,000; preferably between 1,000,000 and 2,000,000; and most preferably between 1,200,000 and 1,500,000 Da. A low molecular weight strength promoter has a weight average molecular weight less than 1,200,000 Da. A medium molecular weight strength promoter has a weight average molecular weight in the range from 1,500,000 to 2,000,000 Da. A high molecular weight strength promoter has a weight average molecular weight greater than 2,000,000 Da. In terms of RSV, strength promoter typically has RSV between 3 to 12 dl/g.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

In at least one embodiment of the invention, a method involves the following steps: 1) Providing a paper furnish, 2) adding strength promoter to the furnish prior to adding a strength agent to the furnish, 3) adding a strength agent to the furnish, and 4) making a paper product from the furnish.

Without being limited in theory and the scope afforded in construing the claims, it is believed that the addition of strength promoter more effectively prevents interactions between anionic trash and the strength agent than prior art methods do. In prior art methods, cationic materials such as inorganic coagulants are added to furnish. These cationic materials work to neutralize the anionic trash. Strength promoters are believed to have a structure and reactivity that is optimal for forming agglomerations with the anionic trash, therefore far more effectively block contact between the anionic trash and the strength agent.

The use of strength promoter to increase the effectiveness of strength agents has previously been disclosed in U.S. patent application Ser. No. 12/323,976. There however it was added to filler particles to prevent interactions between the filler particles and the strength agent. Here the strength promoter is added to the furnish and not to the filler. In at least one embodiment polyacrylamide is glyoxalated to prepare GPAM, which is well-known as a strength agent in the market.

In at least one embodiment, the treating composition of matter is any one of or combination of the compositions of matter described in U.S. Pat. No. 6,592,718. In particular, any of the AcAm/DADMAC copolymer compositions described in detail therein are suitable as the treating composition of matter. An example of an AcAm/DADMAC copolymer composition is product# N-4690 from Nalco Company of Naperville, Ill. (hereinafter referred to as 4690).

The treating composition of matter can be a coagulant with proper molecular weight range or RSV range. The coagulants encompassed in this invention are well known and commercially available.

Some coagulants suitable as a treating composition of matter are formed by condensation polymerization. Examples of polymers of this type include epichlorohydrin-dimethylamine (EPI-DMA), and EPI-DMA ammonia crosslinked polymers.

Additional coagulants suitable as a treating composition of matter include polymers of ethylene dichloride and ammonia, or ethylene dichloride and dimethylamine, with or without the addition of ammonia, condensation polymers of multifunctional amines such as diethylenetriamine, tetraethylenepentamine, hexamethylenediamine and the like with ethylenedichloride and polymers made by condensation reactions such as melamine formaldehyde resins.

Additional coagulants suitable as a treating composition of matter include cationically charged vinyl addition polymers such as polymers, copolymers, and terpolymers of (meth) acrylamide, diallyl-N,N-disubstituted ammonium halide, dimethylaminoethyl methacrylate and its quaternary ammonium salts, dimethylaminoethyl acrylate and its quaternary ammonium salts, methacrylamidopropyltrimethylammonium chloride, diallylmethyl(beta-propionamido)ammonium chloride, (beta-methacryloyloxyethyl)trimethyl ammonium methylsulfate, quaternized polyvinyllactam, vinylamine, and acrylamide or methacrylamide that has been reacted to produce the Mannich or quaternary Mannich derivatives. Preferable quaternary ammonium salts may be produced using methyl chloride, dimethyl sulfate, or benzyl chloride. The terpolymers may include anionic monomers such as acrylic acid or 2-acrylamido 2-methylpropane sulfonic acid as long as the overall charge on the polymer is cationic. The molecular weights of these polymers, both vinyl addition and condensation, range from as low as several hundred to as high as several million. Preferably, the molecular weight range should be from about 20,000 to about 1,000,000.

In at least one embodiment, the coagulant used as a treating composition of matter are copolymers of acrylamide and sodium acrylate or an acrylamide homopolymer that has been hydrolyzed to convert a portion of the acrylamide groups to acrylic acid. In at least one embodiment, the coagulants are copolymers of acrylamide and sodium acrylate. In at least one embodiment, the coagulants are copolymers of acrylamide and sodium acrylate with sodium acrylate content of 5-30 mole % and an RSV of 3-12 dL/g.

Representative examples of strength agents applicable to this invention are GPAMs, such as Nalco Product N-64170 and N63700

In at least one embodiment the molecular weight of the strength promoter is one between the molecular weight of a common coagulant and a flocculant. Common organic coagulants (and in particular organic coagulants) typically refer to polymers having a high charge density with a relatively low molecular weight. In contrast flocculants typically refer to polymers that have a low charge density and high molecular weight. In at least one embodiment the strength promoter is different from both coagulant and flocculants in that its median charge density and its median molecular weight. In at least one embodiment the concentrations of the strength promoter or ratios between cellulose and GPAM that work best is 0.1-2 kg/t, fiber; GPAM or strength agent. It is dosed is typically at 0.5 to 5 kg/ton, fiber.

EXAMPLES

The foregoing may be better understood by reference to the following example, which is presented for purposes of illustration and is not intended to limit the scope of the invention.

Example 1

A thick stock furnish was obtained from a paper mill. The furnish contained 40% COCC and 60% EOCC with 3.5% consistency of the furnish. The thick stock was diluted with tap water to 0.75% consistency.

Handsheets were prepared by mixing 335.0 g 0.75% thin stock at 800 rpm in a Dynamic Drainage Jar with the bottom screen covered by a solid sheet of plastic to prevent drainage. The Dynamic Drainage Jar and mixer were available from Paper Chemistry Consulting Laboratory, Inc., Carmel, N.Y. 15 s after the mixing, proper amount of strength promoter N-4690 (available from Nalco company, Naperville, Ill., 60563) was added; 30 s after the mixing, proper amount of strength additive N-64170 (available from Nalco company, Naperville, Ill., 60563) is added; 45 s after the mixing, 0.4 lb/ton (active based) flocculant N-61067 (available from Nalco company, Naperville, Ill., 60563) was added.

Mixing was stopped at 15 seconds after flocculant was added, and the furnish was transferred into the deckle box of a Haage Kothen handsheet mold (available from AB Lorentzen & Wettre, Sweden). Handsheet with 7.9" diameter were formed by drainage through a 100 mesh forming wire. The handsheet was couched from the sheet mold wire by placing two blotters and a metal plate on the wet handsheet and roll-pressing with six passes of a 25 lb metal roller. The forming wire and one blotter were removed and one new blotter was placed at the wire side. The sandwiched handsheet was then placed into dryer at 92-97° C. under vacuum with pressure of 0.4-0.6 MPa for 7 minutes.

The finished handsheets were stored overnight at TAPPI standard conditions of 50% relative humidity and 23° C. The basis weight (TAPPI Test Method T 410 om-98), ash content (TAPPI Test Method T 211 om-93) for determination of filler content, and tensile strength (TAPPI Test Method T 494 om-01), were measured and listed in Table 1.

In Table 1, condition 1 was furnish without adding strength promoter nor dry strength agent; condition 2 was furnish with 0.1 lb/ton strength promoter N-4690 only; condition 3 and 4 were furnish with 3 and 6 lb/ton strength agent N-64170, respectively; and condition 5 and 6 were furnish with 0.1 lb/ton strength promoter plus 3 and 6 lb/ton strength agent N-64170, respectively.

TABLE 1

Sheet properties of handsheet study in Example 1 and 2.

| | Strength promoter | | Strength agent | | Basis Weight (gsm) | | Ash Content (%) | | Tensile Index (TI)(N · m/g) | | TI Improvement |
|---|---|---|---|---|---|---|---|---|---|---|---|
| Condition | Type | kg/ton | Type | kg/ton | Average | STDEV | Average | STDEV | Average | STDEV | (%) |
| 1 | None | 0.00 | Blank | 0.0 | 83.6 | 1.2 | 9.42 | 0.01 | 30.11 | 1.43 | 0.0 |
| 2 | N-4690 | 0.10 | 0 | 0.0 | 84.4 | 0.6 | 9.95 | 0.12 | 30.47 | 1.56 | 1.2 |
| 3 | None | 0.00 | 64170 | 3.0 | 84.9 | 1.1 | 10.01 | 0.13 | 35.69 | 1.57 | 18.5 |
| 4 | None | 0.00 | 64170 | 6.0 | 87.3 | 1.7 | 10.20 | 0.02 | 38.83 | 0.55 | 29.0 |
| 5 | N-4690 | 0.10 | 64170 | 3.0 | 87.7 | 0.7 | 10.12 | 0.01 | 36.25 | 1.35 | 20.4 |

TABLE 1-continued

Sheet properties of handsheet study in Example 1 and 2.

| | Strength promoter | | Strength agent | | Basis Weight (gsm) | | Ash Content (%) | | Tensile Index (TI)(N · m/g) | | TI Improvement |
|---|---|---|---|---|---|---|---|---|---|---|---|
| Condition | Type | kg/ton | Type | kg/ton | Average | STDEV | Average | STDEV | Average | STDEV | (%) |
| 6 | N-4690 | 0.10 | 64170 | 6.0 | 89.2 | 0.7 | 10.31 | 0.01 | 40.06 | 1.41 | 33.0 |
| 7 | Alum | 5.00 | 64170 | 3.0 | 88.4 | 1.2 | 10.07 | 0.04 | 35.10 | 1.59 | 16.6 |
| 8 | Alum | 5.00 | 64170 | 6.0 | 90.0 | 0.8 | 10.16 | 0.07 | 38.48 | 0.82 | 27.8 |
| 9 | N-7607 | 0.10 | 64170 | 3.0 | 89.7 | 0.6 | 9.89 | 0.12 | 35.20 | 1.22 | 16.9 |
| 10 | N-7607 | 0.10 | 64170 | 6.0 | 90.1 | 0.6 | 10.15 | 0.08 | 36.98 | 2.70 | 22.8 |

Example 2

The method of Example 1 were repeated except that the strength promoter was replaced by commonly used coagulants, i.e. alum and poly-DADMAC or N-7607 (available from Nalco Company, Naperville, Ill., 60563). The finished sheet properties were also measured and listed in Table 1. In condition 7 to 8, strength promoter was replaced by commonly used inorganic coagulant alum; and in condition 9 to 10, it was replaced by commonly used organic coagulant poly-DADMAC N-7607.

Compared with condition 1, furnish treated by strength promoter itself did not increase sheet strength (condition 2). Addition of strength agent N-64170 into furnish at 3 and 6 lb/ton (condition 3 and 4) increased tensile strength 18.5% and 29%, respectively. Furnish treated by strength promoter combined with 3 and 6 lb/ton strength agent (condition 5 and 6) resulted in stronger strength improvement, and tensile strength increased 20.4% and 33%, respectively. Replacing strength promoter N-4690 using inorganic coagulant alum (condition 7 and 8) or organic coagulant N-7607 (condition 9 and 10) did not improve the performance of N-64170.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of increasing the strength of a paper product comprising:

a. adding a strength promoter to a furnish prior to adding a strength agent to the furnish, wherein the strength promoter comprises an acrylamide/diallyldimethylammonium chloride ("AcAm/DADMAC") copolymer, the fibers in the furnish comprising at least 10% fibers sourced from old corrugated cardboard, b. adding a strength agent to the furnish, the strength agent comprising glyoxylated polyacrylamide the dosage ratio of strength promoter relative to strength agent is between 0.1:3 and 0.1:6 wherein the strength agent is dosed relative to the furnish at a dosage of between 3-6 kg/ton, and c. making a paper product using the furnish according to a papermaking process.

2. The method of claim 1, wherein the strength promoter is added in an amount of from about 0.01 to about 3 lb/ton of the furnish.

3. The method of claim 1, wherein the strength promoter has Reduced Specific Viscosity of from about 0.5 to about 15.

4. The method of claim 3, wherein the strength promoter has Reduced Specific Viscosity of from about 1 to about 12.

5. The method of claim 4, wherein the strength promoter has Reduced Specific Viscosity of from about 2 to about 8.

6. The method of claim 5, wherein the strength promoter has Reduced Specific Viscosity of from about 3 to about 6.

7. The method of claim 1, wherein the furnish further comprises fibers selected from the group consisting of recycled fibers, mechanic fibers, and combinations thereof.

8. The method of claim 1, wherein the strength agent is a dry strength agent.

9. The method of claim 1, wherein the strength agent further comprises a compound selected from the group consisting of starch, polyacrylamide, and combinations thereof.

10. The method of claim 1 wherein the fibers in the furnish consist essentially of fibers sourced from old corrugated cardboard.

11. The method of claim 1, wherein the AcAm/DADMAC copolymer has a weight average molecular weight of from about 800,000 to about 3,000,000 daltons.

12. A method of increasing the strength of a paper product-comprising:

a. adding a strength promoter to a furnish prior to adding a strength agent to the furnish, wherein the strength promoter comprises an acrylamide/diallyldimethylammonium chloride ("AcAm/DADMAC") copolymer, the fibers in the furnish comprising at least 10% fibers sourced from old corrugated cardboard, b. adding a strength agent to the furnish, the strength agent comprising glyoxylated polyacrylamide the dosage ratio of strength promoter to strength agent is 0.1:6, the strength agent is dosed relative to the furnish at a dosage of between 3-6 kg/ton, and c. making a paper product using the furnish according to a papermaking process.

* * * * *